United States Patent [19]

Irie et al.

[11] Patent Number: 4,743,183

[45] Date of Patent: May 10, 1988

[54] ROTARY VANE COMPRESSOR WITH DISCHARGE FLUID TO FRONT AND REAR SHAFT BEARINGS AND VANE SLATS

[75] Inventors: Kazuhiro Irie, Yokohama; Mikio Tanino, Hadano, both of Japan

[73] Assignee: Nissan Motor Co., Ltd., Yokohama, Japan

[21] Appl. No.: 892,091

[22] Filed: Aug. 1, 1986

[30] Foreign Application Priority Data

Aug. 5, 1985 [JP] Japan ..... 60-171042

[51] Int. Cl.[4] ..... F04C 18/344; F04C 29/02

[52] U.S. Cl. ..... 418/76; 418/79; 418/82; 418/84; 418/87; 418/94; 418/100

[58] Field of Search ..... 418/76, 79, 84, 87, 418/93, 94, 98–100, 102, 82; 184/6.16

[56] References Cited

U.S. PATENT DOCUMENTS 2,077,394 4/1937 Buenger ..... 418/76
4,144,002 3/1979 Shibuya et al. ..... 418/100
4,484,868 11/1984 Shibuya et al. ..... 418/100

FOREIGN PATENT DOCUMENTS 548830 10/1956 Italy ..... 418/102

OTHER PUBLICATIONS

Compressor Service Manual Cat. No. 525185, published by Diesel Kiki Co., Ltd., Feb. 1985.

*Primary Examiner*—John J. Vrablik
*Attorney, Agent, or Firm*—Leydig, Voit & Mayer

[57] ABSTRACT

A first refrigerant gas passage is provided for conveying refrigerant gas under pressure to rearward ends of rotor vane slots through a rear bearing in order to supply back pressure to the rotor vane slots as well as to supply lubricant to the rear bearing. In addition to the first refrigerant gas passage, there is provided a second refrigerant gas passage for conveying refrigerant gas under pressure to forward ends of the rotor vane slots and a front bearing without conveying through the rear bearing and the rearward ends of the rotor vane slots in order to supply lubricant to the front bearing as well as to apply uniform back pressure on vanes, particularly at the forward and rearward ends thereof.

2 Claims, 4 Drawing Sheets

ROTARY VANE COMPRESSOR WITH DISCHARGE FLUID TO FRONT AND REAR SHAFT BEARINGS AND VANE SLATS

BACKGROUND OF THE INVENTION

1. Field of the Invention

The present invention relates to improvements in a rotary compressor for use in, for example, an automotive air conditioning system.

2. Description of the Prior Art

A rotary compressor, as disclosed in Compressor Service Manual CAT No. 525185 published by Diesel kiki Co., Ltd. in Feb., 1985, has a refrigerant gas passage for supplying refrigerant gas under pressure to rotor vane slots by way of a rear bearing so that vanes are urged by refrigerant gas pressure in the rotor vane slots against an inner peripheral wall of a rotor housing and at the same time the rear bearing is supplied with lubricant contained in the refrigerant gas passing therethrough. The compressor further has a front bearing cooperating with the rear bearing to carry thereon a rotor shaft. The front bearing is supplied with lubricant contained in the refrigerant gas which is transferred thereto through the rear bearing and the rotor vane slots.

A disadvantage of the prior art rotary compressor is that the front bearing tends to wear excessively during a short period of usage since lubricant supplied to the front bearing is liable to become insufficient. Another disadvantage is that irregular pressure is liable to act on each vane, particularly at the forward and rearward ends thereof, thus resulting in irregular contact of the vanes and the inner wall of the rotor housing and therefore excessive wear of same during a short period of usage.

SUMMARY OF THE INVENTION

In accordance with the present invention, there is provided a novel and improved rotary compressor which comprises a rotor housing having an inner peripheral wall, a pair of axially opposite forward and rearward open ends and a discharge port, a pair of front and rear heads arranged at the forward and rearward open ends of the rotor housing to hold therebetween the same, a rotor rotatable within the rotor housing, a plurality of vanes retractably installed on the rotor for contact with the inner peripheral wall of the rotor housing, a plurality of rotor vane slots for applying back pressure on the vanes so as to urge the same against the inner peripheral wall of the rotor housing, the rotor vane slots being elongated axially of the rotor to have forward and rearward ends, a rotor shaft extending through the rotor housing and installing thereon the rotor to rotate therewith, a pair of front and rear bearings respectively installed on the front and rear heads and carrying thereon the rotor shaft, the front head having an intake port through which fluid is drawn into the rotor housing and discharged therefrom through the discharge port of the rotor housing after being increased in pressure as the rotor rotates, and first back pressure supply conduit means for conveying part of fluid discharged from the discharge port to the rearwards ends of the rotor vane slots through the rear bearing.

The above structure may substantially follow the conventional fashion. In accordance with the present invention, the rotary compressor further comprises second back pressure supply conduit means for conveying part of fluid discharged from the discharge port to the forward ends of the rotor vane slots and the front bearing without conveying same through the rear bearing and the rearward ends of the rotor vane slots.

The above structure is quite effective for overcoming the disadvantages and shortcomings inherent in the prior art device.

It is accordingly an object of the present invention to provide a novel and improved rotary compressor which can assuredly apply uniform pressure on vanes, particularly at the forward and rearward ends thereof, make movement of the vanes smoother and prevent chattering of the vanes as well as excessive wear of same and an associated inner peripheral wall of a rotor housing during a short period of usage.

It is another object of the present invention to provide a novel and improved rotary compressor of the above described character which can supply sufficient lubricant to a front bearing and thereby prevent excessive wear of same during a short period of usage.

DETAILED DESCRIPTION OF THE PREFERRED EMBODIMENTS

Figure 1:
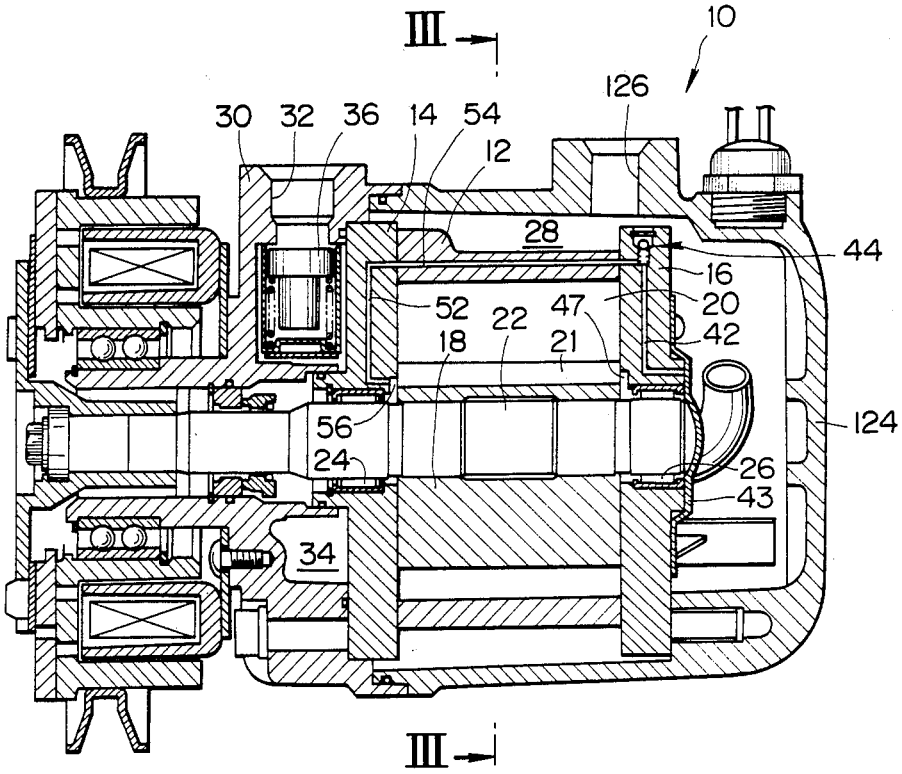
FIG. 1 is a longitudinal sectional view of a rotary compressor for an air conditioner according to an embodiment of the present invention.
Figure 2:
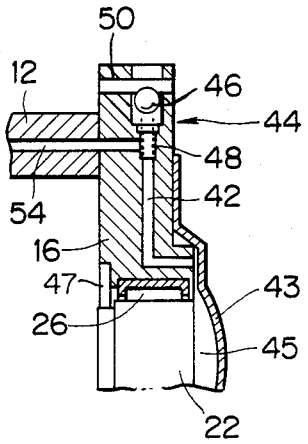
FIG. 2 is an enlarged fragmentary sectional view of the rotary compressor of FIG. 1 for showing the detail of a first refrigerant gas passage and a vane back pressure control valve employed therein.
Figure 3:
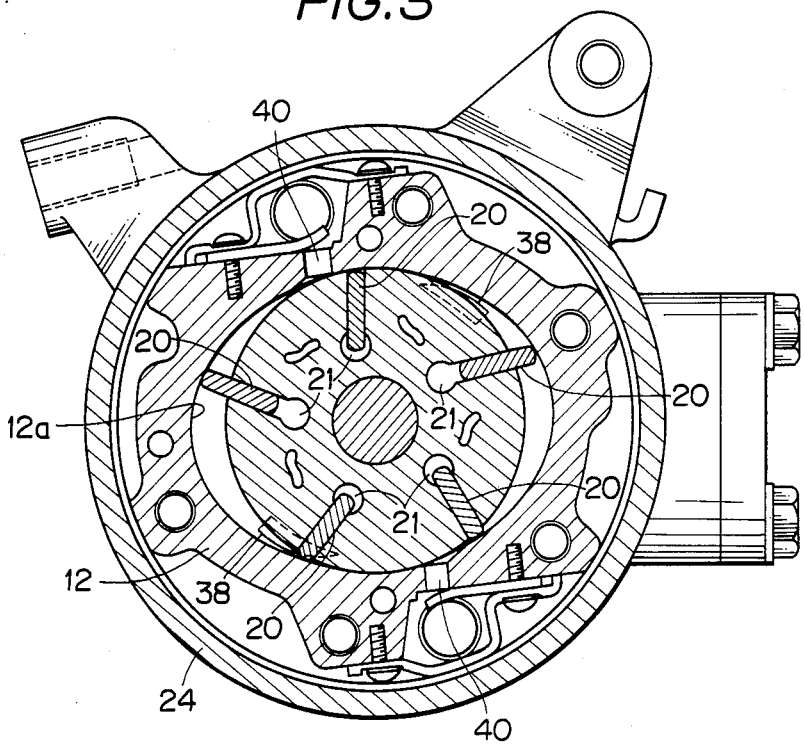
FIG. 3 is a sectional view taken along the line III—III of FIG. 1.

Referring to FIGS. 1 through 3, a rotary compressor is generally indicated by the reference numeral 10 and shown as comprising a tubular rotor housing 12 with an oval-shaped inner wall 12*a* and a pair of axially opposite forward and rearward open ends, a pair of annular front and rear heads 14, 16 at the forward and rearward open ends of the rotor housing 12 to hold therebetween the same, a rotor 18 rotatable within the rotor housing 12, a plurality of vanes 20 retractably installed on the rotor 18 for contact with the inner wall 12*a* of the rotor housing 12, a plurality of rotor vane slots 21 for applying back pressure on the vanes 20 so as to urge the same against the inner wall 12*a* of the rotor housing 12, a rotor shaft 22 extending through the rotor housing 12 and installing thereon the rotor 18 to rotate therwith, a pair of front and rear bearings 24, 26 (e.g. roller bearings as shown) respectively installed on the front and rear heads 14, 16 and carrying thereon the rotor shaft 22, a rear outer casing 124 having an outlet 126 and receiving therewithin the rear head 16, rotor housing 12 and part of the front head 14 to define therearound a discharge passage 28 in communication with the outlet 126, and a front outer casing 30 having an inlet 32 and receiving therewithin the remaining part of the front head 14 to define an intake passage 34 in communication with the inlet 32 by way of a check valve 36 so that refrigerant gas is taken through the inlet 32 and intake passage 34 and through intake ports 38 into the inside of the rotor housing 12 to be compressed thereat and discharged outside of the compressor 10 through discharge ports 40 formed in the rotor housing 12 and through the discharge passage 28 and outlet 26.

In order to introduce refrigerant gas under pressure to the rotor vane slots 21, the rear head 16 is provided with a first refrigerant gas passage 42 and a vane back pressure control valve 44 disposed in the first refrigerant gas passage 42 for controlling the pressure to be supplied to the rotor vane slots 21 in such a manner that the back pressure in the rotor vane slots 21 is maintained lower than a predetermined value in order to prevent seizure of the vanes 20. In this instance, refrigerant gas is supplied to the rotor vane slots 21 through the rear bearing 26 for lubrication thereof since refrigerant gas is added with lubricant to this end. More specifically, the first refrigerant gas passage 42 is generally in the form of a radial opening having a radially outer end opening to the outer circumferential periphery of the rear head 16 and a radially inner end bent to extend axially and open to a rearward end of the rear head 16 at a place adjacent the rear bearing 26. A rear head cover 43 is sealingly attached to the rearward end of the rear head 16 so as to define a disk-like space 45 providing communication between the inner end of the first refrigerant gas passage 42 and the rear bearing 26. The space 45 is also communicated through the rear bearing 26 with an annular space 47 defined between the forward end portion of the inner circumferential periphery of the rear head 16 and the rotor shaft 22, which space 47 is in turn communicated with the rearward ends of the rotor vane slots 21. The vane back pressure control valve 44 is disposed in a first refrigerant gas passage 42 at a place adjacent the outer end thereof and consists of a ball 46 movable between a first position where it seats (i.e. the valve 44 closes) and a second position where it unseats (i.e. the valve 44 opens), a spring 48 urging the ball 46 toward the second position, and a stopper pin 50 abuttingly engageable with the ball 46 in the second position. The spring 48 is designed so that the control valve 44 opens when $P_d<(P_d+P_s)/2+S_p$ and closes when $P_d>(P_d+P_S)/2+S_p$ where $P_d$ is the pressure at the outlet 26, $P_s$ is the pressure at the inlet 32 and $S_p$ is the pressure supplied from the spring 48 to the ball 46. With the control valve 44, back pressure expressed by $(P_d+P_S)/2$ is supplied to the rotor vane slots 21.

The above structure may substantially follow the conventional fashion. In accordance with the present invention, the front head 14 is provided with a second refrigerant gas passage 52 at a place downstream of the control valve 44 by way of a bypass 54 provided to the rotor housing 12 and the other end in communication with the forward ends of the rotor vane slots 21 and the front bearing 24. More specifically, the second refrigerant gas passage 52 is generally in the form of a radial opening having a radially outer end bent to extend axially and open to the rearward end of the front head 14 where it communicates with the forward end of the bypass passage 54 in the form of an axial opening extending through the circumferential wall of the rotor housing 12, which axial opening is connected at the rearward end thereof to the first refrigerant gas passage 42 at a place downstream of the control valve 44. A radially inner end of the second refrigerant gas passage 52 is bent to extend axially and open to the rearward end of the front head 14 where it communicates with an annular space 56 defined between the forward end portion of the inner circumferential periphery of the front head 14 and the rotor shaft 22, which space 56 is in turn communicated with the forward ends of the rotor vane slots 21 and the front bearing 24.

From the foregoing, it is to be understood that upon opening of the control valve 44 sufficient lubricant contained in refrigerant gas can be supplied to the front bearing 24 as well as the rear bearing 26.

It is further to be understood that uniform pressure can be supplied to the forward and rearward ends of the rotor vane slots 21, thus making it possible to attain smooth movement of the vanes 20 and thereby prevent excessive wear of the vanes 20 and the inner peripheral wall **12*a* of the rotor housing 12** due to irregular contact thereof.

Figure 4:
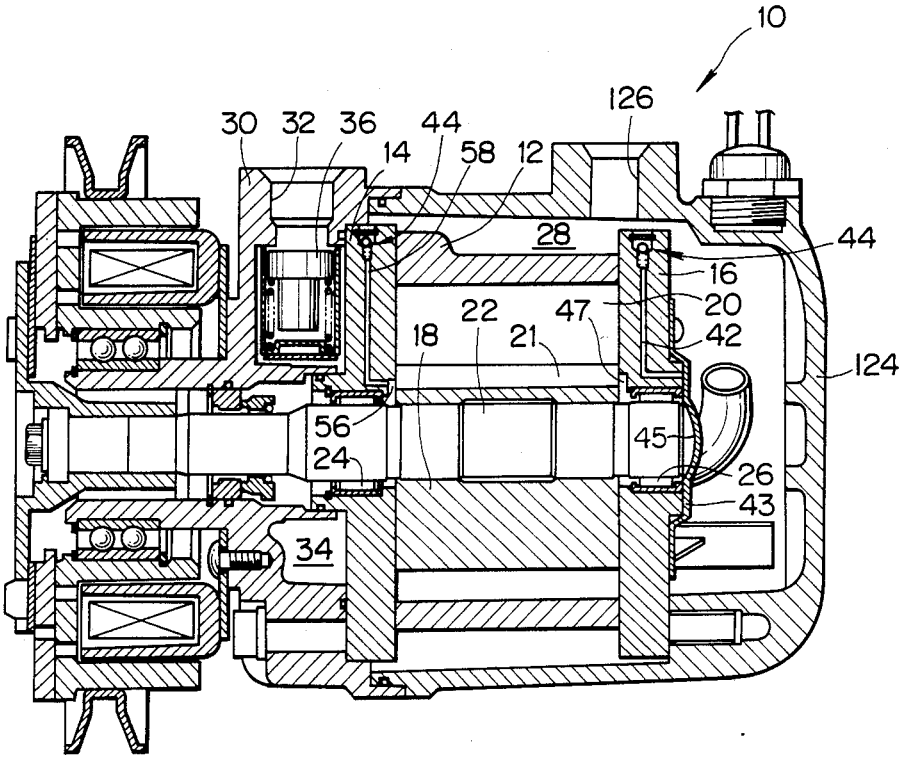
FIGS. 4 and 5 are views similar to FIG. 1 but showing modified embodiments of the present invention.

FIG. 4 shows a modified embodiment of the present invention. This embodiment differs from the previous embodiment in that a second refrigerant gas passage 58 is constructed and arranged independently of the first refrigerant gas passage 42, namely, the second refrigerant gas passage 58 has a radially outer end opening to the outer circumferential periphery of the front head 14 where it communicates with the discharge passage 28 and is provided with a vane back pressure control valve 44 which is contructed and arranged similarly to what is disposed in the first refrigerant gas passage 42.

With this modification, uniform pressure can be supplied to the forward and rearward end of the rotor vane slots 21 with an increased accuracy and reliability, thus making it possible to attain much smoother movement of the vanes 20 and thereby prevent, more assuredly, excessive wear of the vanes 20 and the inner wall **12*a* of the rotor housing 12** due to irregular contact thereof. Except for the above, this embodiment is substantially similar to the previous embodiment and can produce substantially the same effect as the previous embodiment.

Figure 5:
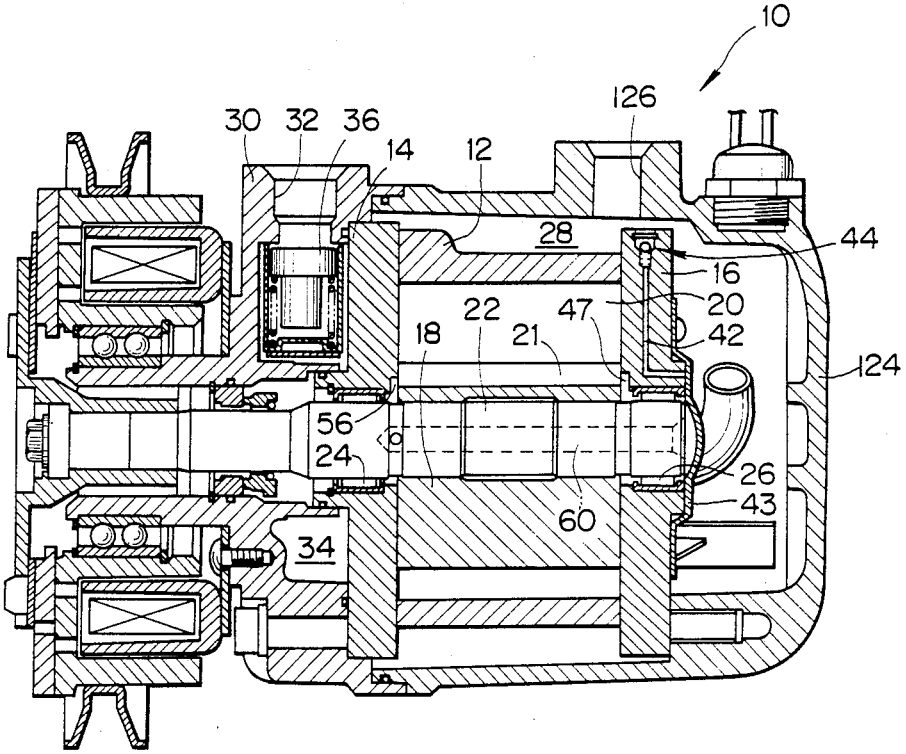

FIG. 5 shows another modified embodiment of the present invention. This embodiment differs from the previous embodiment of FIGS. 1 through 3 in that a second refrigerant gas passage 60 is provided to the rotor shaft 22 to establish communication between the spaces 45, 56. More specifically, the second refrigerant gas passage 60 is generally in the form of an axial opening concentrically formed in the rotor shaft 22 and having a rearward end opening to the rearward end of the rotor shaft 22 where it communicates with the space 45 and a forward end bent to extend radially and open to the circumferential wall of the rotor shaft 22 where it communicates with the annular space 56.

With this embodiment, the second refrigerant gas passage 60 can be attained easily and economically, thus resulting in a reduced manufacturing cost. Except for the above, this embodiment is substantially similar to the previous embodiment of FIGS. 1 through 3 and can produce substantially the same effect as the previous embodiment.

What is claimed is:

1. A rotary compressor comprising:

a rotor housing having an inner peripheral wall, a pair of axially opposite forward and rearward open ends and a discharge port;

a pair of front and rear heads arranged at said forward and rearward open ends of said rotor housing to hold there between the same;

a rotor rotatable within said rotor housing;

a plurality of vanes retractably installed on said rotor for contact with said inner peripheral wall of said rotor housing;

a plurality of rotor vane slots for applying back pressure on said vanes so a to urge the same against said inner peripheral wall of said rotor housing, said rotor vanes slots being elongated axially of said rotor to have forward and rearward ends;

a rotor shaft extending through said rotor housing and installing thereon said rotor to rotate therewith;

a pair of front and rear bearings respectively installed on said front and rear heads and carrying thereon said rotor shaft;

said front head having an intake port through which fluid is drawn into said rotor housing and discharged therefrom through said discharge port of said rotor housing after being increased in pressure as said rotor rotates;

first back pressure supply conduit means for conveying part of fluid discharged from said discharge port to said rearward ends of said rotor vane slots through said rear bearing;

second back pressure supply conduit means for conveying part of fluid discharged from said discharge port to said forward ends of said rotor vane slots and said front bearing without conveying same through said rear bearing and said rearward ends of said rotor vane slots;

said first back pressure supply conduit means comprises a first refrigerant gas passage provided to said rear head and having an end opening outside of said rear head and the other end in communication with said rearward ends of said rotor vane slots through said rear bearing, and a vane back pressure control valve disposed in said first refrigerant gas passage for controlling back pressure to be supplied to said rotor vane slots in such a manner that said back pressure in said rotor vane slots is maintained lower than a predetermined value; and said second back pressure supply conduit means comprises a bypass passage formed in said rotor housing and having an end in communication with said first refrigerant gas passage at a place downstream of said back pressure control valve and the other end located at said forward open end of said rotor housing and a second refrigerant gas passage formed in said front head and having an end in communication with said other end of said bypass passage and the other end in communication with said forward ends of said rotor vane slots and said front bearing.

2. A rotary compressor as set forth in claim 1, further comprising a rear outer casing having an outlet and receiving therewithin said rear head, said rotor housing and part of said front head to define therearound a discharge passage providing communication between said outlet and said discharge ports, and a front outer casing having an inlet and receiving therewithin the remaining part of said front head to define an intake passage providing communication between said inlet and said intake ports.

* * * * *